US010245849B2

(12) United States Patent
Valero Navazo et al.

(10) Patent No.: US 10,245,849 B2
(45) Date of Patent: Apr. 2, 2019

(54) VAPOR CONTROL HEATING IN A PRINTER

(71) Applicant: HEWLETT-PACKARD DEVELOPMENT COMPANY, L.P., Houston, TX (US)

(72) Inventors: Juan Manuel Valero Navazo, Barcelona (ES); Francisco Javier Perez Gellida, Sant Cugat del Valles (ES); Emilio Angulo Navarro, Barcelona (ES); Ezequiel Jordi Rufes Bernad, Sant Feliu de Llobregat (ES); Marina Cantero Lazaro, Barcelona (ES); Antonio Gracia Verdugo, Barcelona (ES); Santiago Sanz Ananos, Barcelona (ES); Roger Bastardas Puigoriol, Barcelona (ES); Mikel Zuza Irurueta, Sant Cugat del Valles (ES); Oriol Borrell Avila, Sabadell (ES); Eva Blay Lerin, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 24 days.

(21) Appl. No.: 15/118,271

(22) PCT Filed: Mar. 26, 2014

(86) PCT No.: PCT/US2014/031886
§ 371 (c)(1),
(2) Date: Aug. 11, 2016

(87) PCT Pub. No.: WO2015/130325
PCT Pub. Date: Sep. 3, 2015

(65) Prior Publication Data
US 2016/0355027 A1 Dec. 8, 2016

(30) Foreign Application Priority Data
Feb. 26, 2014 (WO) ..... PCT/US14/18689

(51) Int. Cl.
*B41J 11/00* (2006.01)
*B41J 29/377* (2006.01)
(Continued)

(52) U.S. Cl.
CPC ..... *B41J 11/002* (2013.01); *B41J 2/01* (2013.01); *B41J 29/377* (2013.01); *H05B 3/00* (2013.01); *H05B 2203/035* (2013.01)

(58) Field of Classification Search
CPC ..... B41J 11/002; B41J 29/38; B41J 29/377; B41J 2/01; H05B 2203/035
(Continued)

(56) References Cited

U.S. PATENT DOCUMENTS 4,502,056 A 2/1985 Matsuda
4,675,695 A 6/1987 Samuel et al.
(Continued)

FOREIGN PATENT DOCUMENTS

CN 102171043 8/2011
CN 102574406 7/2012
(Continued)

OTHER PUBLICATIONS

Cochior, C. et al.; Cold Start Control of Industrial Printers ; http://ieeexplore.ieee.org/xpl/articleDetails.jsp?tp=&arnumber=6265982&queryText%3Dprinter+temperature+control ; Jul. 11, 2012.
(Continued)

*Primary Examiner* — Jannelle M Lebron
(74) *Attorney, Agent, or Firm* — HP Inc. Patent Department

(57) ABSTRACT

In one example, a vapor control heater for a printer includes a housing, a heating element at least partially enclosed by
(Continued)

the housing, and a fan to move air over the heating element and into a flow of air from the printer dryer.

18 Claims, 12 Drawing Sheets

(51) Int. Cl.
*B41J 2/01* (2006.01)
*H05B 3/00* (2006.01)

(58) Field of Classification Search
USPC ..... 347/17, 18, 102
See application file for complete search history.

(56) References Cited

U.S. PATENT DOCUMENTS

| | | | | |
|---|---|---|---|---|
| 5,089,830 | A | 2/1992 | Cha et al. | |
| 5,239,164 | A | 8/1993 | Hirota | |
| 5,737,674 | A | 4/1998 | Venkatesan et al. | |
| 5,920,331 | A | 7/1999 | Silverbrook | |
| 6,390,618 | B1 | 5/2002 | Wotton et al. | |
| 6,439,712 | B1 | 8/2002 | Mizutani et al. | |
| 6,554,514 | B2 | 4/2003 | Wotton et al. | |
| 6,771,916 | B2 | 8/2004 | Hoffman et al. | |
| 8,275,278 | B2 | 9/2012 | Ishigaya et al. | |
| 8,351,815 | B2 | 1/2013 | Eden et al. | |
| 2004/0183879 | A1 | 9/2004 | Nakazawa | |
| 2009/0027472 | A1 | 1/2009 | Sekiya | |
| 2010/0282910 | A1 | 11/2010 | Stothers et al. | |
| 2011/0036255 | A1 | 2/2011 | Monclus et al. | |
| 2011/0228025 | A1 | 9/2011 | Miyamoto et al. | |
| 2011/0228289 | A1* | 9/2011 | Yamamoto | B41J 11/002 358/1.8 |
| 2011/0267410 | A1* | 11/2011 | Yamamoto | B41J 11/002 347/102 |
| 2013/0215203 | A1* | 8/2013 | Chen | B41J 11/002 347/102 |
| 2014/0292921 | A1* | 10/2014 | Tanaka | B41J 2/1714 347/34 |

FOREIGN PATENT DOCUMENTS

| | | |
|---|---|---|
| CN | 102712200 | 10/2012 |
| CN | 102729658 | 10/2012 |
| DE | 102011010071 | 8/2012 |
| EP | 2174787 | 4/2010 |
| JP | S58114976 | 7/1983 |
| JP | H06314046 | 11/1994 |
| JP | H1120144 | 1/1999 |
| JP | 2006-95774 | 4/2006 |
| JP | 2007121354 | 5/2007 |
| JP | 2009214416 | 3/2008 |
| JP | 2009234103 | 3/2008 |
| JP | 2010-125828 | 6/2010 |
| JP | 2010125818 | 6/2010 |
| JP | 2010-143007 | 7/2010 |
| JP | 2011-230494 | 11/2011 |
| JP | 2013-166258 | 8/2013 |
| JP | 2013149006 | 8/2013 |
| WO | WO2015/130275 | 9/2015 |
| WO | WO2015/130325 | 9/2015 |
| WO | WO2015/130326 | 9/2015 |

OTHER PUBLICATIONS

Crouch, K.G. et al.:The Control of Press Cleaning Solvent Vapors in a Small Lithographic Printing Establishment: http://www.tandfonline.com/doi/abs/10.1080/104732299302918#.UnOOF7UcyYQ > On pp. 329-338; Nov. 30, 2010.

Yoneya, A., et al.; Rapid Zero-cross Switch Control of AC Resistive Load with Deep Delta-sigma Modulator; http://ieeexplore.ieee.org/xpl/articleDetails.jsp?tp=&arnumber=6119395&queryText%3Dprevent+flicker+zero+cross+power+share >; Nov. 7-10, 2011.

* cited by examiner

VAPOR CONTROL HEATING IN A PRINTER

BACKGROUND

Inkjet printers use printheads with tiny nozzles to dispense ink or other printing fluid on to paper or other print substrates. Some inkjet printers use water-based and other very low volatility inks to help prevent ink from drying on and clogging the nozzles, and otherwise to help improve the performance of the printer and the quality of the printed image.

DRAWINGS

The same part numbers designate the same or similar parts throughout the figures.

DESCRIPTION

Water-based and other low volatility inks are desirable for many inkjet printing applications to help prevent ink from drying on and clogging printhead nozzles, and otherwise to help improve the performance of the printer and the quality of the printed image. Water based inks are commonly referred to as latex" inks. Powerful blow driers are often used in latex and other low volatility ink printers to quickly evaporate the moisture in the ink immediately after the image is applied to the print substrate. The moisture in the hot air flowing out of the printer downstream from the dryer may condense into vapor that can produce a noticeable fog, particularly at high print volumes in cooler operating environments. A vapor control heater has been developed to introduce warm air into the moisture laden air leaving the printer to help reduce the risk of unwanted condensation. If condensation is stopped in the air stream leaving the printer, it will then be more difficult for condensation to form as the air stream disperses into the area surrounding the printer.

Examples of the vapor control heater are not limited to use with hot air blow driers, but may be used with other types of dryers or without a dryer. Also, in some examples, a vapor control heater may be incorporated into an air heating system that also includes a print zone heater that raises the temperature of the print zone to help maintain good print quality in cooler operating environments. The examples shown in the figures and described herein illustrate but do not limit the disclosure, which is defined in the Claims following this Description.

As used in this document: a "printhead" means that part of an inkjet printer or other inkjet type dispenser that dispenses fluid, for example as drops or streams; and "printing fluid" means fluid that may be dispensed with a printhead. A "printhead" is not limited to printing with ink but also includes inkjet type dispensing of other fluid and/or for uses other than printing.

Figure 1:
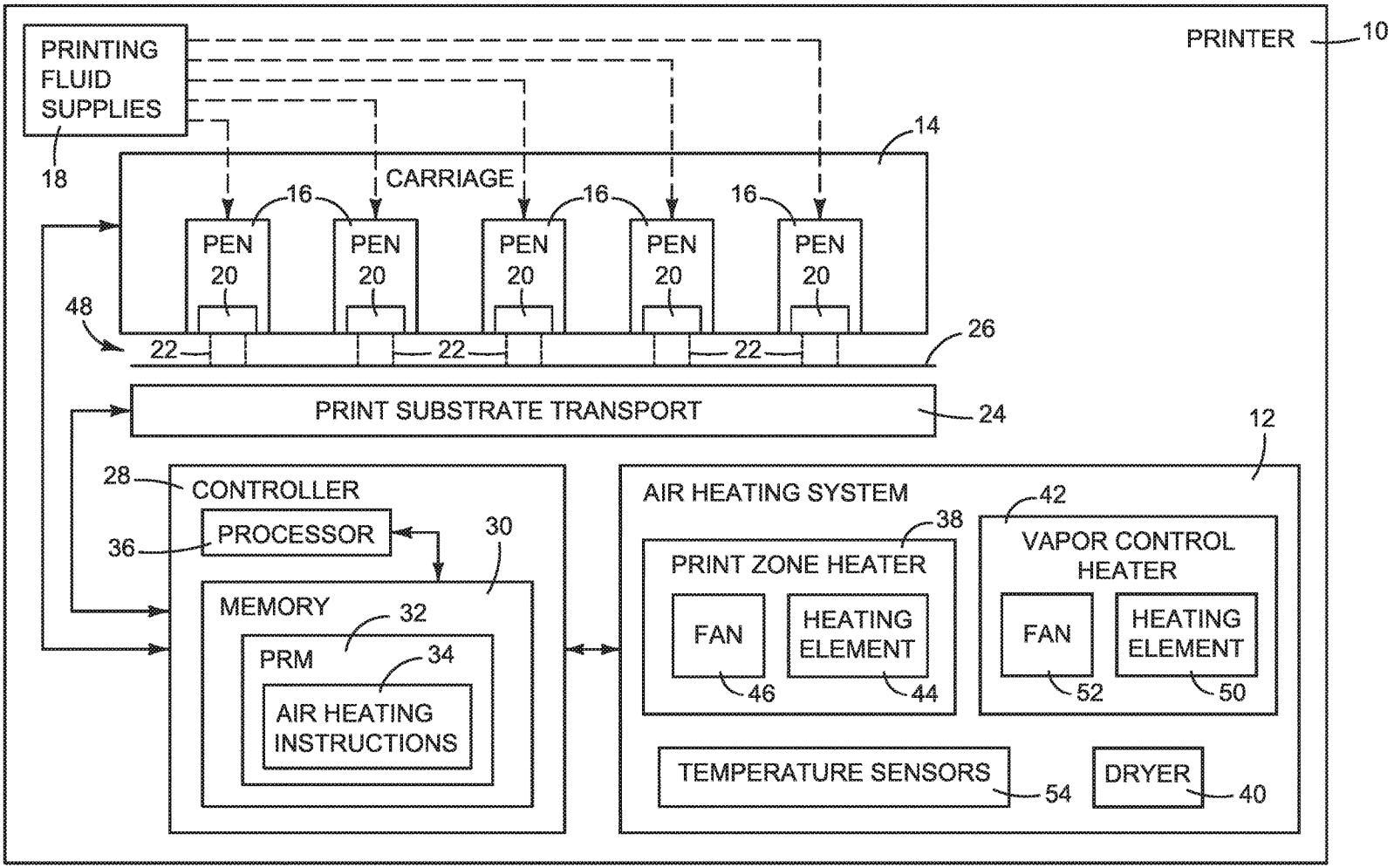
FIG. 1 is a block diagram illustrating an inkjet printer implementing one example of a new air heating system that includes a print zone heater and a vapor control heater.

FIG. 1 is a block diagram illustrating an inkjet printer 10 implementing one example of an air heating system 12. Referring to FIG. 1, printer 10 also includes a carriage 14 carrying multiple ink pens 16 connected to printing fluid supplies 18. Inkjet ink pens 16 are also commonly referred to as ink cartridges or print cartridges and may dispense ink and other printing fluids from a printhead or multiple printheads 20 contained within each pen 16, for example as drops or streams 22. A transport mechanism 24 advances a paper or other print substrate 26 past carriage 14 and ink pens 16. A controller 28 is operatively connected to heating system 12, carriage 14, printheads 20 and substrate transport 24. Controller 28 represents the programming, processors and associated memory, and the electronic circuitry and components needed to control the operative elements of printer 10. In particular, controller 28 includes a memory 30 having a processor readable medium (PRM) 32 with instructions 34 for controlling the functions of heating system 12 and a processor 36 to read and execute instructions 34.

A scanning carriage 14 with pens 16 illustrates just one example of a printhead assembly that may be used with air heating system 12. Other types of printhead assemblies are possible. For example, instead of ink pens 16 with integrated printheads 20 shown in FIG. 1, the printhead(s) could be mounted separately on carriage 14 with replaceable ink containers operatively connected to the carriage mounted printhead(s). Although remote printing fluid supplies 18 are shown, the printing fluids could be located on carriage 14 or contained within each pen 16. Also, instead of a scanning carriage 14, printhead(s) spanning a full width of print substrate 26 that remain stationary during printing could also be used.

In this example, air heating system 12 includes a print zone heater 38, a dryer 40, and a vapor control heater 42. Print zone heater 38 includes a heating element 44 and a fan 46 to move heated air into a print zone 48 where ink or other printing fluid is (or will be) dispensed from printheads 20 on to substrate 26. Vapor control heater 42 includes a heating element 50 and a fan 52 to move heated air into the stream of air leaving the printer downstream from dryer 40. Heating system 12 may also include temperature sensors 54 associated with heaters 38 and 42 and operatively connected to controller 28 to help control the heating functions of each heater. Each temperature sensor 54 may be implemented in a thermostat or other temperature control device as part of system 12 or as a discrete part otherwise connected to controller 28.

Figure 2:
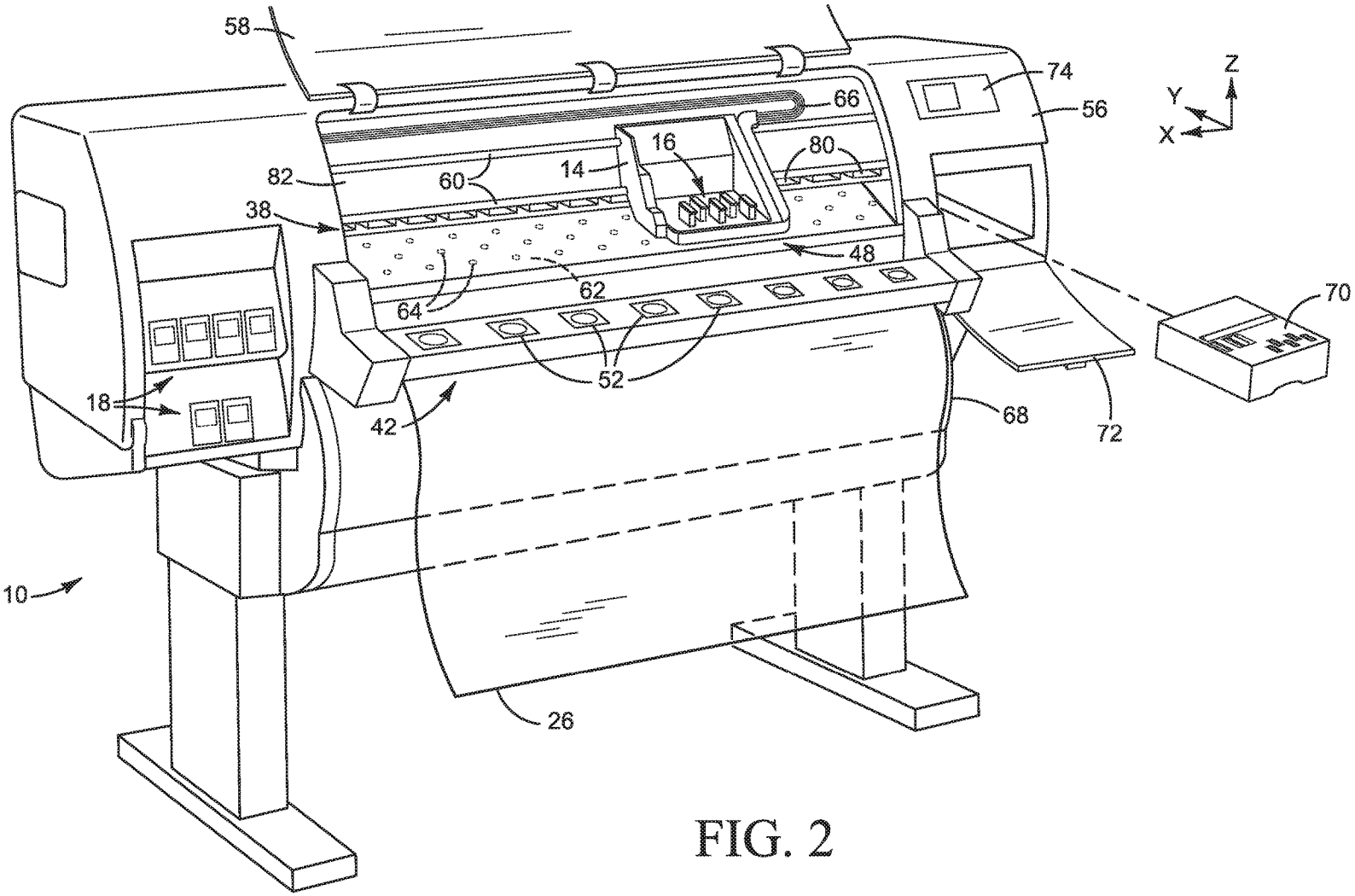
FIG. 2 illustrates a large format inkjet printer implementing one example of an air heating system.

FIG. 2 illustrates a large format inkjet printer 10 implementing one example of an air heating system 12. Referring to FIG. 2, carriage 14 carrying pens 16 is enclosed in a printer housing 56. Carriage 14 and print zone 48 may be accessed through a door 58 in housing 56. Door 58 is open in FIG. 2 to show carriage 14 and print zone 48. Carriage 14 slides along rails 60 over a platen 62. Platen 62 supports a print substrate web 26 as it passes under carriage 14 for printing with pens 16. In the example shown, platen 62 includes vacuum holes 64 connected to a vacuum system (not shown) to help hold substrate 26 flat in print zone 48. Printer 10 also includes ink supply containers 18 supported in housing 56 and connected to pens 16 through flexible tubing 66. A supply roll (not shown) of web substrate 26 is supported in a lower part 68 of housing 56. Printer 10 may also include a service module 70 at one end of platen 62 accessed through a service door 72 and a local display and control panel 74.

Figure 3:
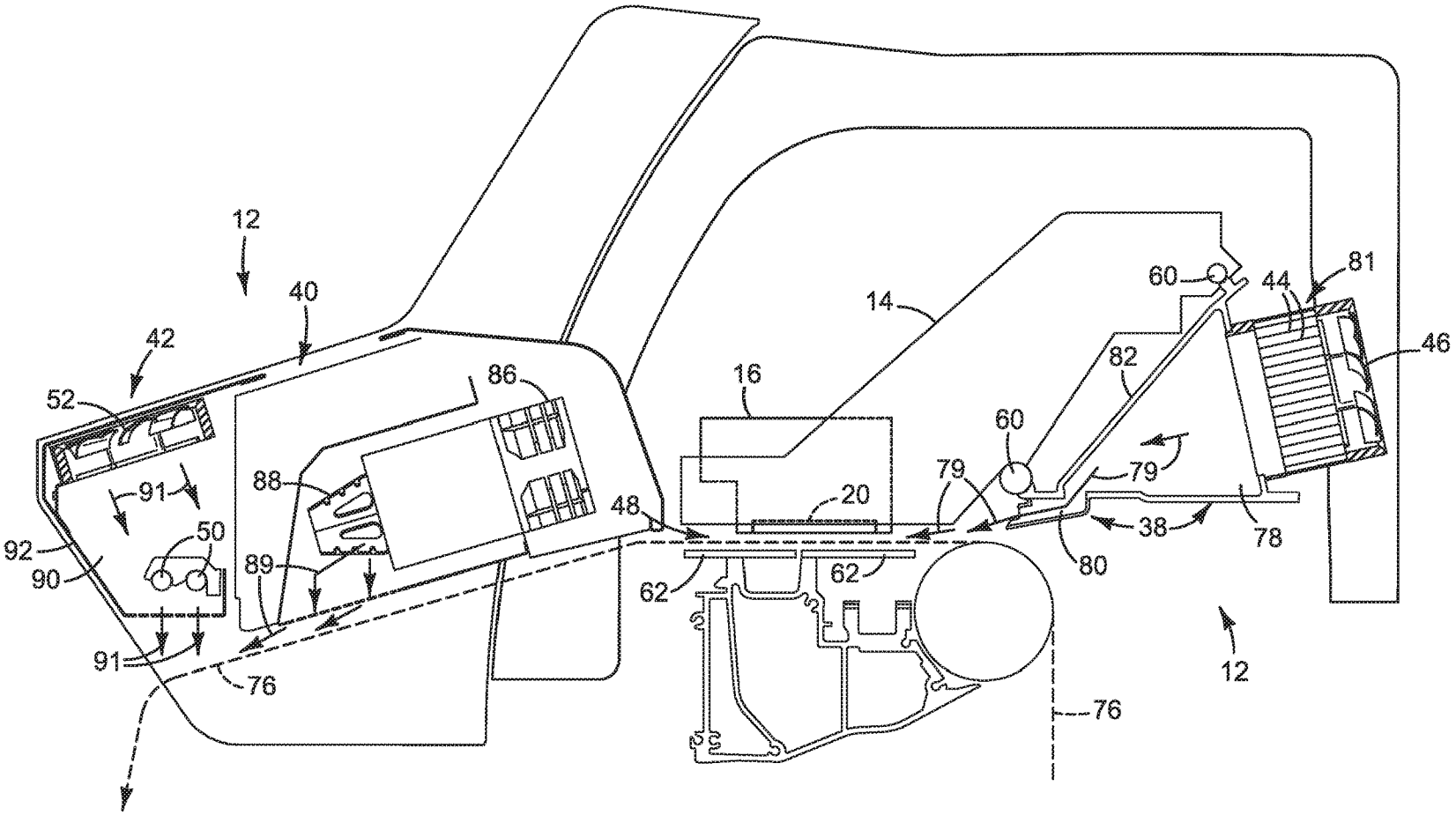
FIG. 3 is a side elevation view showing the air heating system in the printer shown in FIG. 2.
Figure 4:
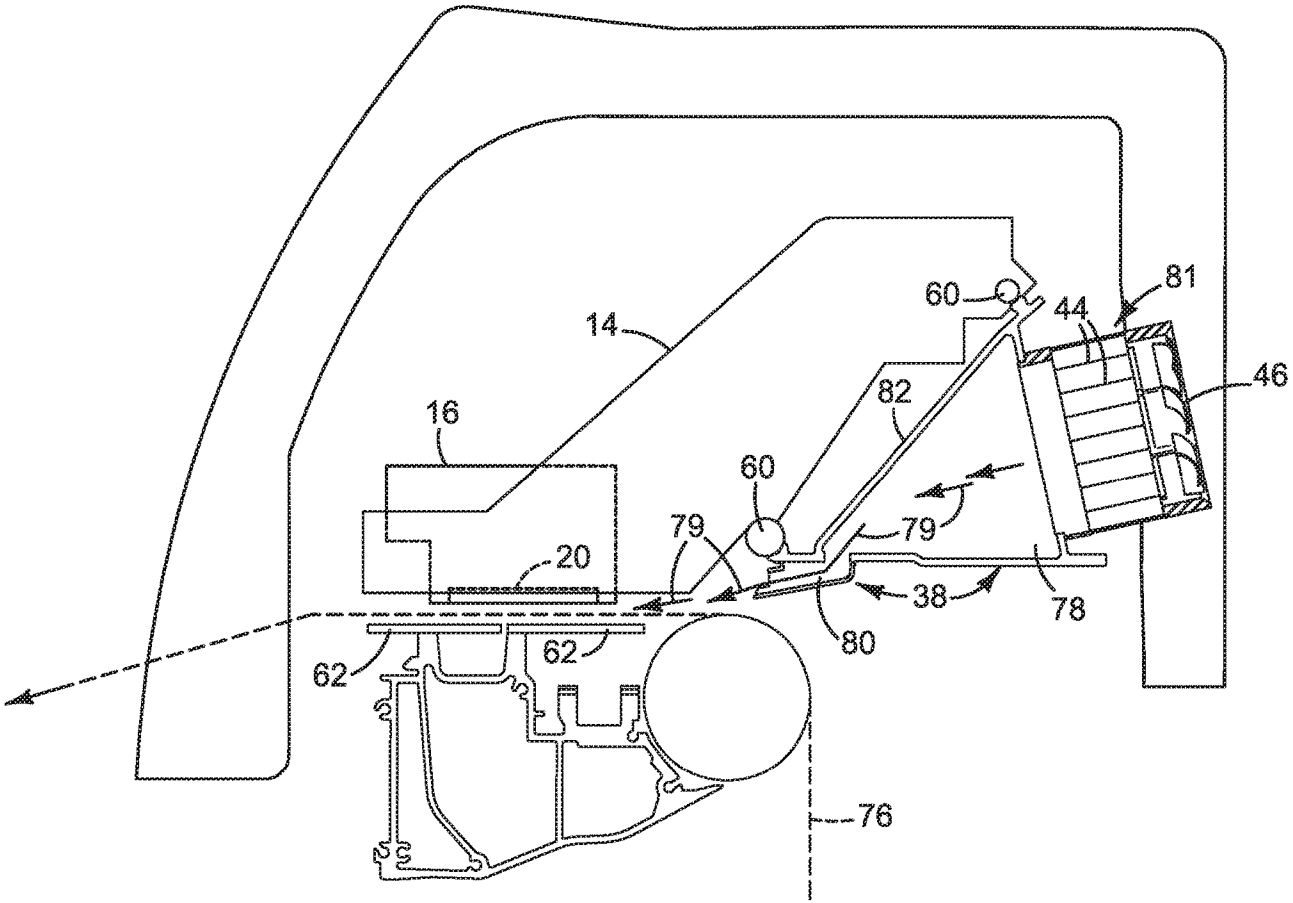
FIG. 4 is a side elevation view of the print zone heater in the air heating system in the printer shown in FIGS. 2 and 3.
Figure 5:
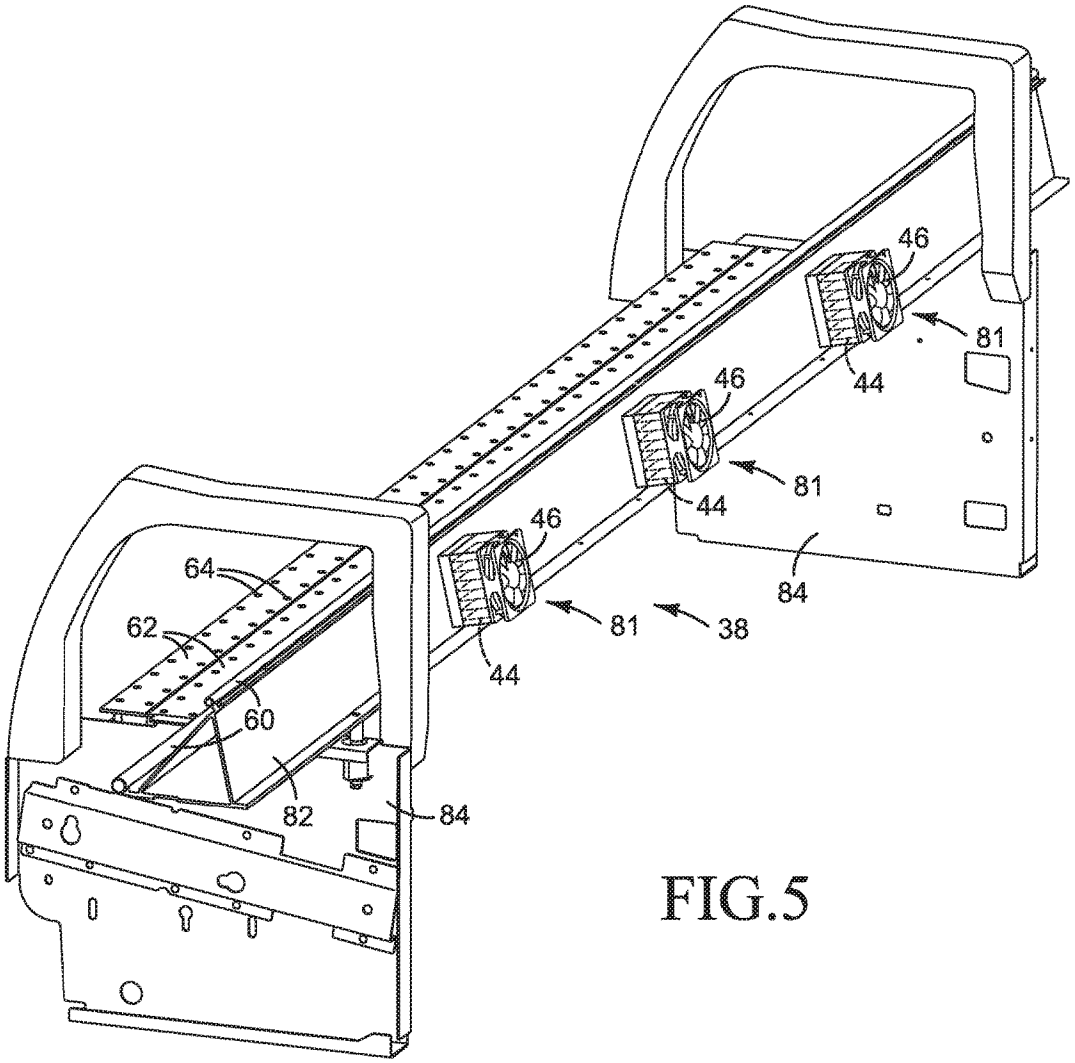
FIGS. 5-7 illustrate the print zone heater of FIG. 4 in more detail.
Figure 6:
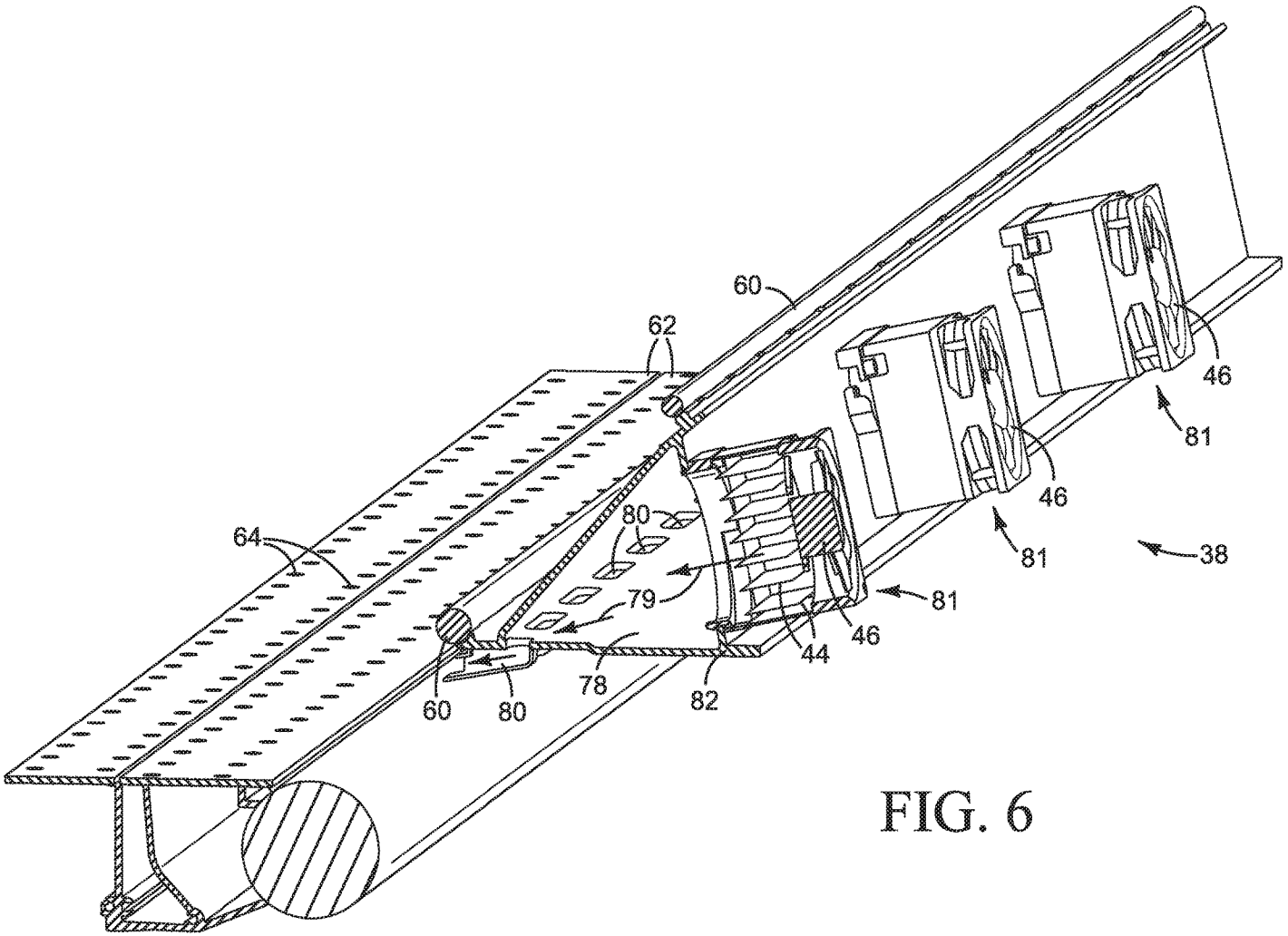
Figure 7:
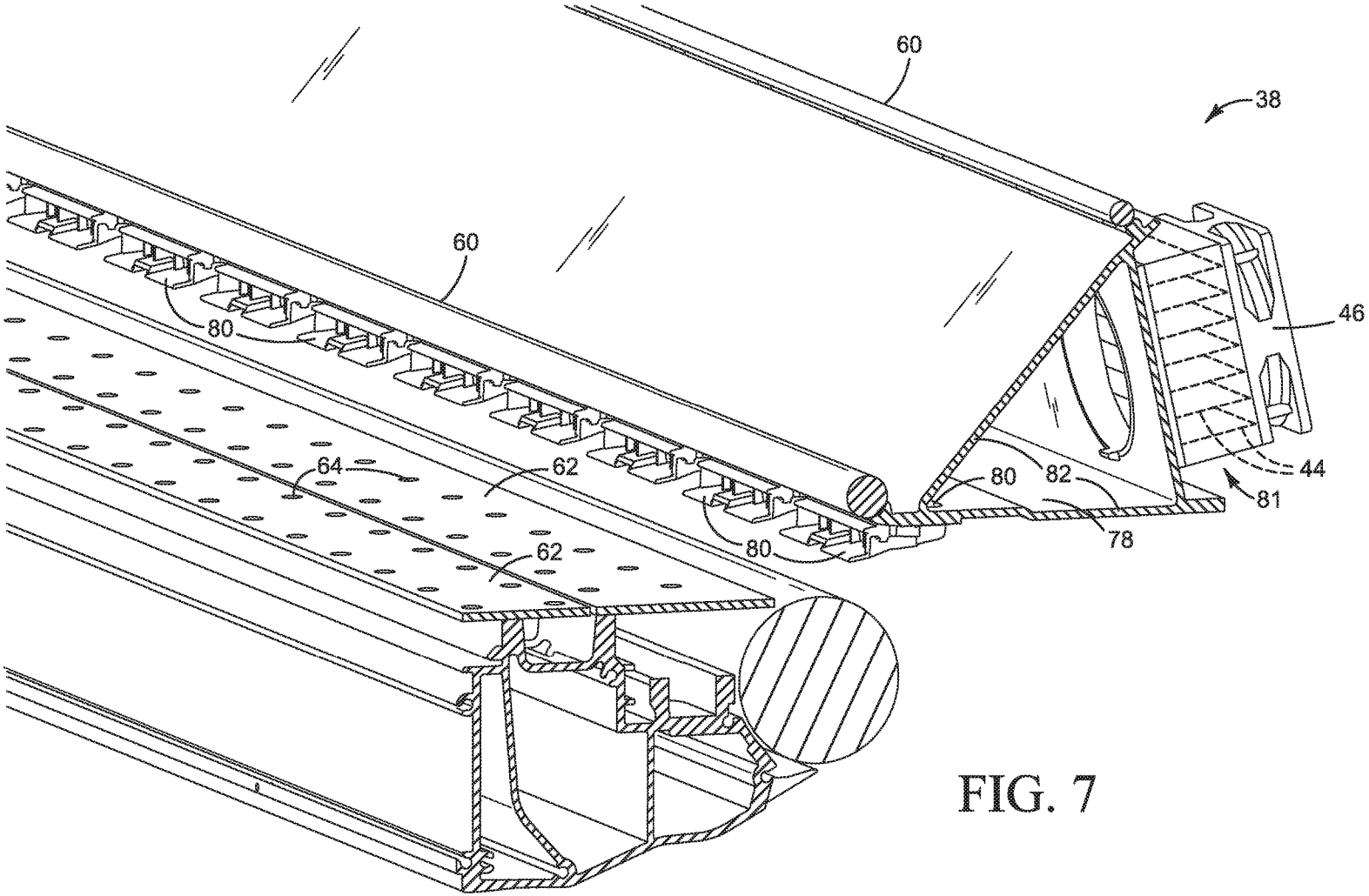

FIG. 3 is a side elevation view showing air heater system 12 from printer 10 in FIG. 2. FIGS. 4-7 show print zone heater 38 in system 12 in more detail. Referring to FIGS. 3-7, print zone heater 38 is positioned upstream from printheads 20 along the path 76 print substrate 26 moves through printer 10. In this example, heater 38 includes a plenum 78 and conduits 80 to carry heated air from plenum 78 to print zone 48. Conduits 80 are oriented to direct heated air on to and along print substrate 26 in the direction substrate 26 moves through print zone 48 during printing. Also, in this example, a discrete heating element 44 is integrated into a heating module 81 with each fan 46 and the fans 46 are positioned upstream from the heating elements 44 in the direction of air flow 79 through heater 38 to print zone 48. Thus, each fan 46 blows air over a corresponding heating element 44 into plenum 78 for distribution across the full width of print zone 48 through conduits 80.

Other suitable print zone air heating configurations are possible. For example, more or fewer fans 46 and conduits 80 could be used. However, the rate of air flow into the print zone should be low enough to avoid adversely affecting the placement of printing fluid on the print substrate. While it is expected that heaters associated with each fan, such as those shown in FIGS. 3-7, will be more efficient in this comparatively low flow application, a single heating element or a single group of heating elements common to all of the fans could be used and/or the fans could be positioned downstream from the heating element(s) to draw air through the heating element(s) into the plenum. For another example, heated air could be ducted directly to the print zone without a plenum. Nevertheless, it is expected that a plenum usually will be desirable to help efficiently distribute heated air to the print zone. Also, plenum 78 shown in the figures is defined by a triangular structure 82 affixed to a printer chassis 84 (FIG. 5) to support carriage rails 60. Structure 82 is sometimes referred to as a "scan beam" because it functions as a structural support beam for printhead carriage 14 as it is scanned back and forth on rails 60 across print zone 48 during printing. Thus, in the example shown, scan beam 82 functions both as a plenum 78 in print zone heater 38 and a support for carriage 14.

Print quality problems associated with cooler ambient temperatures usually are worse at the beginning of a print job when the temperature in the print zone is lower. As the printer works, the print zone warms and print quality improves. Print zone heater 38 may include a variable power heating element 44 to supply more heat when the print zone is cooler and less heat when the print zone is warmer. Alternatively, two (or more) discrete heating elements 44 could be used to vary the power output of heater 38. A temperature sensor 54 (FIG. 1) may be used to monitor the temperature of print zone 48 to help control heating element(s) 44 and fan(s) 46 in print zone heater 38.

Figure 8:
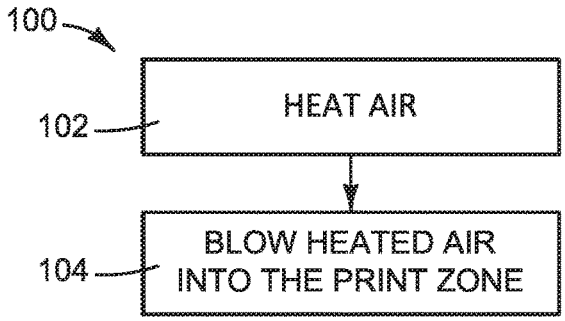
FIG. 8 is a flow diagram illustrating one example of a method for heating a print zone such as might be implemented with the print zone heater shown in FIGS. 3-7.
Figure 9:
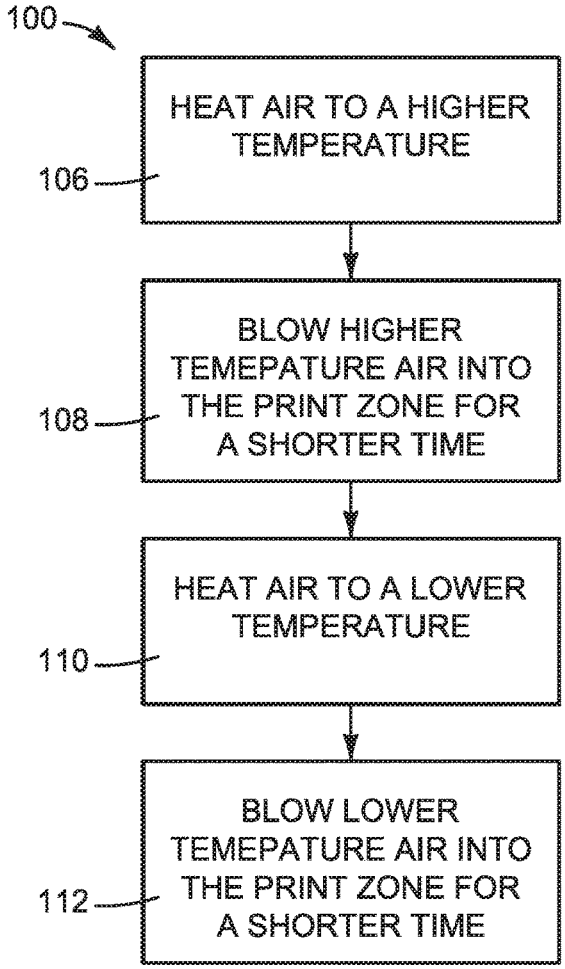
FIG. 9 is a flow diagram illustrating one example for implementing the air heating step in the method of FIG. 8.

FIG. 8 is a flow diagram illustrating one example of a method 100 for heating a print zone, such as might be implemented with print zone heater 38 shown in FIGS. 3-7. The method of FIG. 8 may be performed, for example, at the direction of controller 28 executing air heating instructions 34. Referring to FIG. 8, air is heated (step 102) and the heated air is blown into the print zone upstream from the printhead(s) in a direction downstream along the path the print substrate is moved through the printer, as indicated by air flow arrows 79 in FIGS. 3 and 4 (step 104). FIG. 9 is a flow diagram illustrating one specific implementation for method 100 shown in FIG. 8. Referring to FIG. 9, air is heated to a first temperature (step 106) and blown into the print zone for a first time (step 108). Then the air is heated to a second temperature lower than the first temperature (step 110) and blown into the print zone for a second time longer than the first time (step 112). For example, air is heated at the first, higher temperature and blown into the print zone for the first, shorter time to quickly warm the print zone at the beginning of a print job when the print zone is cool and then the air temperature is reduced to continue to maintain the print zone at the desired temperature during printing.

While the operating parameters of a print zone heater 38 may vary depending on the particular printer and printing environment as well as the number, size and configuration of the fan(s) and heating element(s), testing indicates that for an inkjet printer 10 with a print zone 48 up to about 2.64 m wide operating at a room temperature of about 15° C., a desired print zone temperature of about 30° C. may be reached and maintained by: (1) initially applying more power through one or multiple heating elements 44 to heat the air to a higher temperature, about 55° C. for example, to quickly warm the print zone to the desired temperature; and then (2) reducing the power through heating element 44 to heat the air to a lower temperature, about 40° C. for example, to maintain the desired print zone temperature during printing.

Referring again to FIG. 3, printer 10 also includes a dryer 40 positioned downstream from print zone 48 to dry ink and other printing fluids dispensed on to print substrate 26. In this example, dryer 40 includes a fan 86 and heating element 88 to blow hot air on to print substrate 26, as indicated by flow arrows 89. Dryer 40 usually will deliver much hotter air at much higher air flows compared to print zone heater 38, for example to quickly evaporate water from latex inks. The moisture in the hot air flowing out of printer 10 downstream from dryer 40 may condense into vapor that can produce a noticeable fog, particularly at high print volumes in cooler operating environments. Accordingly, a vapor control heater 42 may be added to introduce warm air into the moisture laden air leaving the printer to inhibit vapor condensing out of the air.

Figure 10:
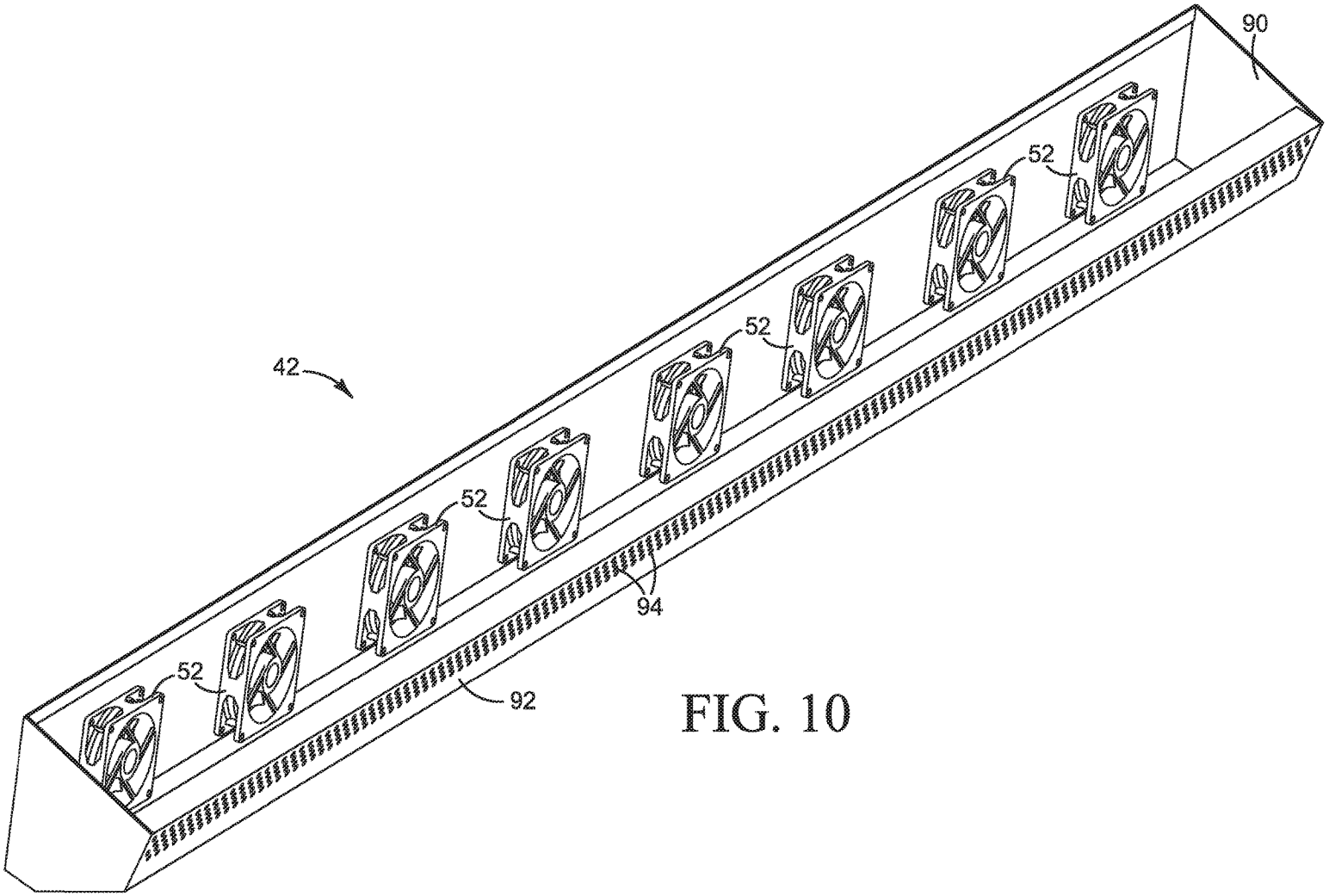
FIGS. 10 and 11 illustrate the vapor control heater in the air heating system shown in the printer shown in FIG. 3 in more detail.
Figure 11:
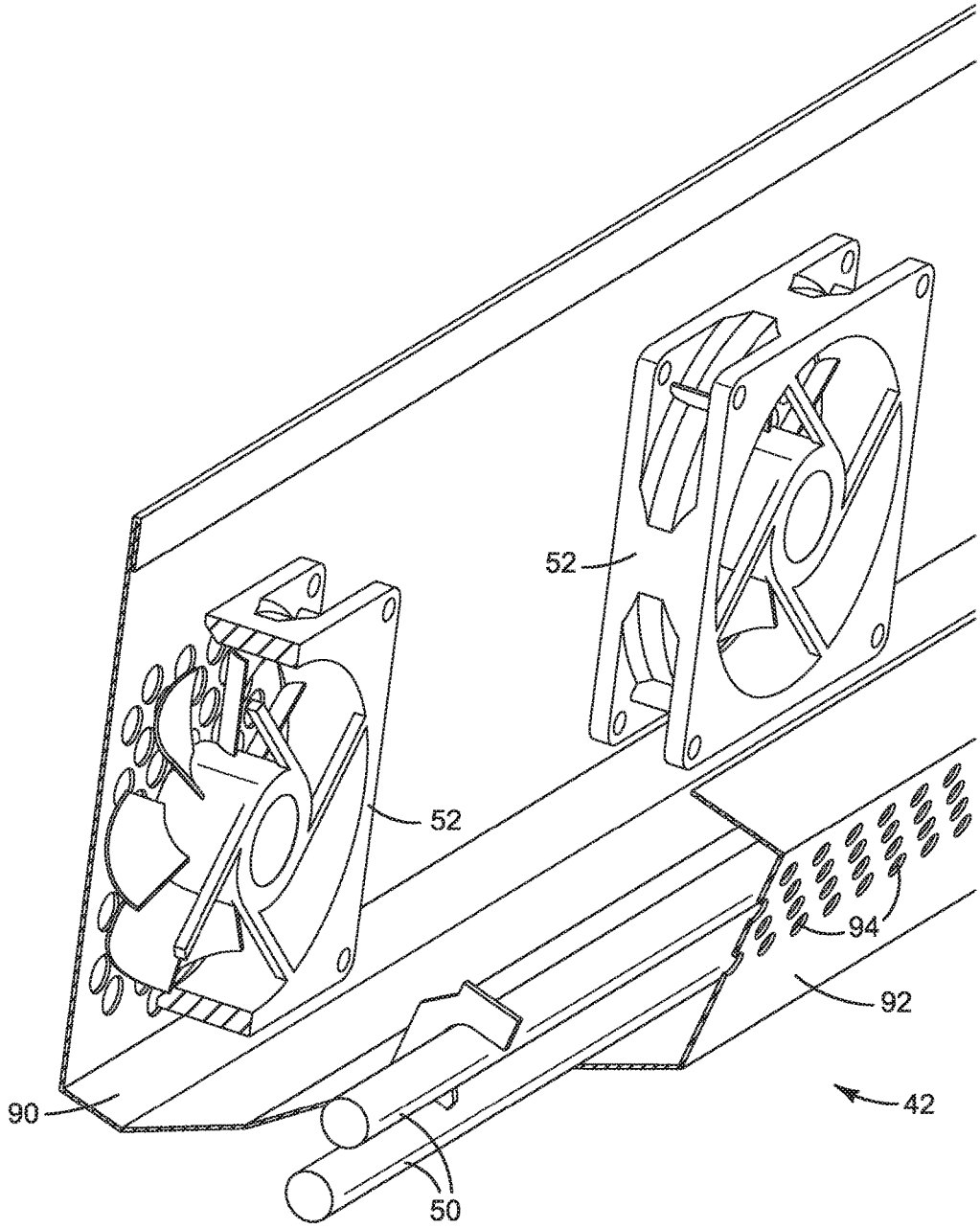

Referring now also to the detail views of FIGS. 10 and 11, vapor control heater 42 includes a group of fans 52 positioned across the width of print substrate 26 to draw ambient air into a plenum 90 and blow the air over heating elements 50 and out into the moisture rich air downstream from dryer 40, as indicated by flow arrows 91 in FIG. 3. Plenum 90 is defined in part by a housing 92 that also supports fans 52. In the example shown, two elongated heating elements 50 spanning the full width of print substrate 26 are mounted along the bottom of housing 92 and air is discharged from plenum 90 through an array of holes 94 in housing 92 immediately downstream from heating elements 50.

Vapor control heater 42 can provide the heat needed to prevent moisture condensing in the flow of air exiting the printer. If condensation is stopped in the air stream leaving the printer, it will then be more difficult for condensation to form as the air stream disperses into the area surrounding the printer. The power output of heater 42 may be varied by energizing one or both heating elements 50, for example to supply more heat for high density or high speed printing on vinyl and other less absorbent substrates and less heat for lower density or lower speed printing on more absorbent substrates. Alternatively, a single variable power heating element could be used to vary the heat level or a constant power heating element could be used when no variation in power level is desired.

Other suitable vapor control heating configurations are possible. For example, individual heating elements corresponding to each fan could be used, the fans could be positioned downstream from the heating element(s) to draw air through the heating element(s) into the plenum, more or fewer fans could be used, and/or heated air could be ducted directly to the print zone without a plenum. However, unlike the lower flow print zone heater, the vapor control heater usually will utilize a much higher air flow to provide the desired mixing. Thus, it is expected that more and/or higher volume fans and heating element(s) spanning the width of the print substrate will be desirable for most printing environments compared to the print zone heater.

Figure 12:
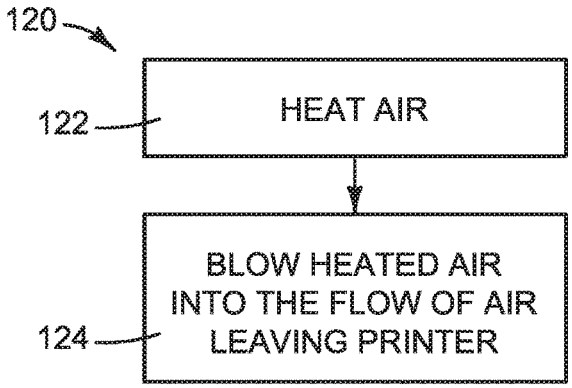
FIG. 12 is a flow diagram illustrating one example of a method for introducing heated air into the discharge air flow such as might be implemented with the vapor control heater shown in FIGS. 3, 10 and 11.

FIG. 12 is a flow diagram illustrating one example of a method 120 for introducing heated air into the discharge air flow such as might be implemented with vapor control heater 42 shown in FIGS. 3, 10 and 11. The method of FIG. 12 may be performed, for example, at the direction of controller 28 executing air heating instructions 34. Referring to FIG. 10, air is heated (step 122) and the heated air is blown into the flow of air leaving the printer (step 124).

Figure 13:
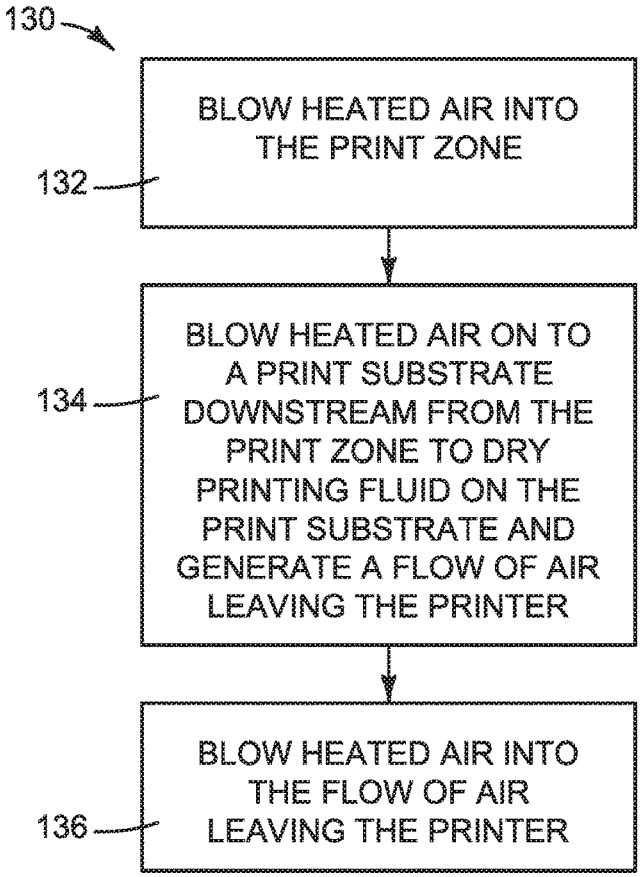
FIG. 13 is a flow diagram illustrating one example of a method for print zone heating and vapor control such as might be implemented with the heaters in FIGS. 3-11.

FIG. 13 is a flow diagram illustrating one example of a method 130 for print zone heating and vapor control such as might be implemented with heater 38, dryer 40 and heater 42 in FIG. 3. The method of FIG. 13 may be performed, for example, at the direction of controller 28 executing air heating instructions 34. Referring to FIG. 13, heated air is blown into the print zone (step 132). Heated air is blown on to a print substrate downstream from the print zone to dry printing fluid on the print substrate, generating a flow of air leaving the printer (step 134). Heated air is blown into the flow of air leaving the printer (step 136).

A temperature sensor 54 (FIG. 1) may be used to monitor the room temperature to help control heating element 50 and fans 52 in vapor control heater 42. For example, if the room temperature is high enough that there is little risk of condensation in the air stream leaving the printer, then heater 42 may remain off or be turned off, or its heat output set to a lower level by adjusting heating element(s) 50 or fans 52, or both. Other control algorithms may be used as an alternative to or with temperature control. For example, heater 42 may be controlled based the amount of ink to be printed. Less or no vapor control may be desired for lower ink print jobs while more vapor control may be desired for higher ink print jobs.

Figure 14:
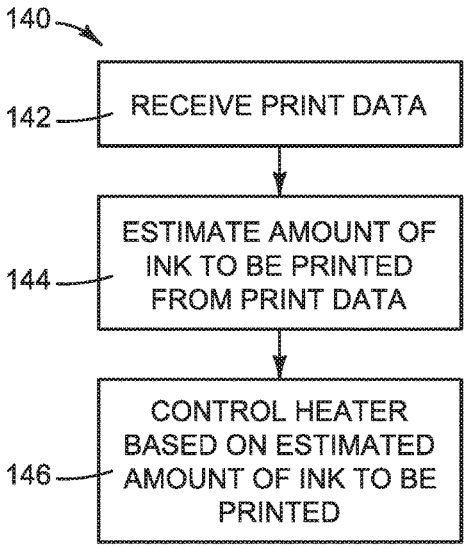
FIG. 14 is a flow diagram illustrating one example of a method for controlling a vapor control heater.
Figure 15:
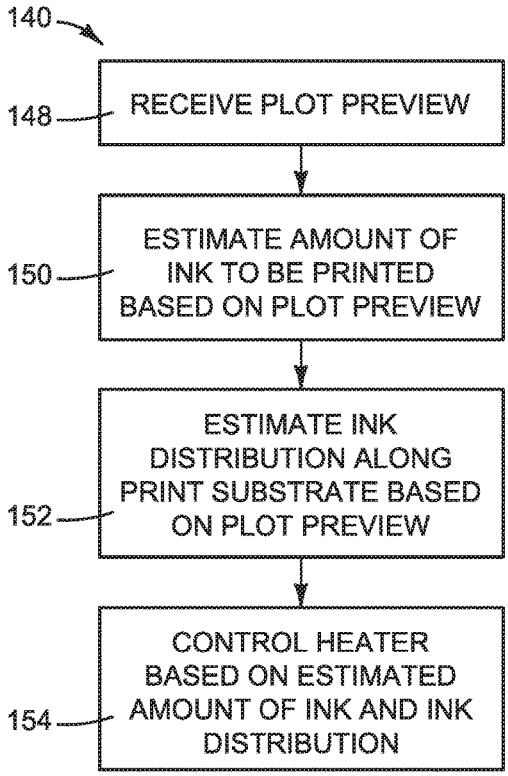
FIG. 15 is a flow diagram illustrating another example of a method for controlling a vapor control heater.

FIGS. 14 and 15 are flow diagrams illustrating two examples of a method 140 for controlling a vapor control heater such as heater 42 shown in FIGS. 3, 10 and 11 based on an estimate of the amount of ink to be printed. Method 140 in FIGS. 14 and 15 may be performed, for example, at the direction of controller 28 executing air heating instructions 34. Referring first to FIG. 14, controller 28 receives the actual print data (block 142), estimates the amount of ink to be printed from the print data (block 144), and then controls the output of heater 42 based on the estimated amount of ink to be printed (block 146).

For large format printing applications, the printer controller usually will receive the print data swath by swath, rather than all at once. It may not always be possible to turn heater 42 on and off, or otherwise adjust the output of heater 42, fast enough to achieve the desired vapor control conditions using swath by swath ink estimates. Where more lead time is desired, the ink estimates may be based on a "plot preview" received before the actual print data. Many large format printers receive a plot preview from the raster image processor before receiving the actual print data, for example to preview the print job on the printer control panel. Even at the typically low resolution of a plot preview, the amount of ink for the print job can be estimated with sufficient accuracy to determine whether or not vapor control heater 42 should be activated (or remain activated) and, if yes, at what level of heat output. For longer print jobs, the distribution of ink on the plot preview may be used to adjust heater 42 during printing. In the example of method 140 shown in FIG. 15, printer controller 28 receives a plot preview (block 148) and estimates the amount of ink to be printed based on the plot preview (block 150) and, for longer print jobs, the distribution of ink along the print substrate 26 (block 152). The output of heater 42 is controlled based on the estimated amount of ink for the print job and, if desired, based on the estimated distribution of ink along the substrate (block 154).

Control options for both examples include leaving heater 42 off, leaving heater 42 on, turning heater 42 on, turning heater 42 off, and adjusting heating element(s) 50 to supply more or less heat, and adjusting fans 52 to supply more or less air flow.

Figure 16:
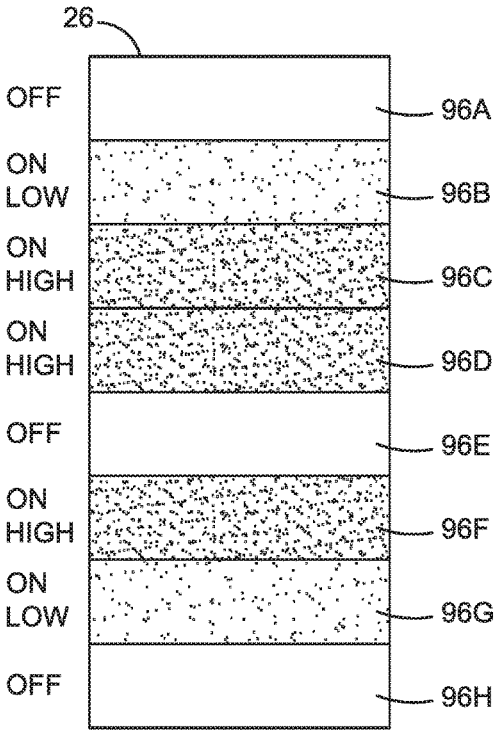
FIG. 16 illustrates one example an ink distribution along a print substrate such as might be used to control a vapor control heater.

FIG. 16 illustrates one example an ink distribution along a print substrate 26 such as might be used to control heater 42 as described above. Referring to FIG. 15, substrate 26 is divided into regions 96A-96H. The length of each region 96A-96H may be selected, for example, based on the time it takes heater 42 to respond to control commands relative to the advance of substrate 26 past ink pens 20. In this example, heater 42 is on high in higher ink regions 96C, 96D and 96F (indicated by more dense stippling), heater 42 is on low in lower ink regions 96B and 96G (indicated by less dense stippling), and heater 42 is off in even lower ink regions 96A, 96E and 96H (indicated by no stippling).

It may not be desirable in all printing applications to utilize both a print zone heater 38 and a vapor control heater 42. For example, for printers without a hot air dryer or for lower production printers in which condensation is not likely to be a problem, a vapor control heater may be undesirable even in cooler operating environments in which a print zone heater is beneficial. For another example, a print zone heater may be unnecessary in operating environments regularly at or above the desired print zone temperature whether or not a vapor control heater is used to inhibit condensation. Thus, an air heating system for a printer, such as system 12 shown in FIG. 1, may include a print zone heater 38 or a vapor control heater 42, or both.

"A" and "an" used in the claims means one or more.

As noted at the beginning of this Description, the examples shown in the figures and described above illustrate but do not limit the disclosure. Other examples are possible.

Therefore, the foregoing description should not be construed to limit the scope of the disclosure, which is defined in the following claims.

What is claimed is:

1. A vapor control heater for a printer having a dryer to dry a print substrate leaving a print zone, comprising:

a housing;

a heating element at least partially enclosed by the housing; and a fan to move air over the heating element and into an air flow from the dryer after the air flow passes over the print substrate.

2. The heater of claim 1 , wherein:

the housing comprises an elongated housing at least partially defining a plenum that spans the full width of the print zone; and the fan comprises multiple fans spaced apart across the plenum to blow air into the plenum, over the heating element, and out through holes in the housing into the air flow from the dryer.

3. The heater of claim 2, wherein the plenum is a single plenum and the heating element comprises an elongated heating element inside the plenum spanning the full width of the print zone.

4. The heater of claim 3, wherein the heating element comprises multiple elongated heating elements each spanning the full width of the print zone.

5. The heater of claim 1, further comprising a temperature sensor, the heater being controlled based on output from the temperature sensor.

6. The heater of claim 5, wherein the temperature sensor is arranged to detect a room temperature where the printer is located;

the heater further comprising a controller to discontinue operation of the heater when the detected room temperature where the printer is located exceeds a threshold.

7. The heater of claim 1, wherein:

the fan comprises a group of fans positioned across a width of a path of the print substrate; and the group of fans are supported by a housing defining a plenum that receives air drawn by the group of fans.

8. The heater of claim 1, further comprising a controller to vary a level of heat output by the heater based on absorbency of the print substrate.

9. The heater of claim 1, further comprising a controller to vary a level of heat output by the heater based on a plot preview received before actual print data as an indication of a quantity of ink to be dispensed.

10. An air heating system for an inkjet printer having a print zone in which printing fluid may be dispensed on to a print substrate, the system comprising:

a dryer to blow heated air on to the print substrate after printing fluid is dispensed on to the substrate in the print zone; and a vapor control heater to blow heated air into an air flow from the dryer after the air flow passes over the print substrate.

11. The system of claim 10, wherein the vapor control heater comprises:

a housing;

a heating element at least partially enclosed by the housing; and a fan to move air over the heating element and into the air flow from the dryer.

12. The system of claim 10, further comprising a controller to estimate an amount of ink to be printed and control the vapor control heater based on the estimated amount of ink.

13. The system of claim 12, wherein:

the controller is to estimate an amount of ink to be printed based on a plot preview; and the controller is to control the vapor control heater based on the estimated amount of ink by one or more of starting the vapor control heater, stopping the vapor control heater, adjusting a temperature of the vapor control heater, and adjusting a flow of the vapor control heater.

14. A non-transitory processor readable medium having instructions thereon that when executed cause a printer to operate a vapor control heater that is separate from a print substrate dryer of the printer, the vapor control heater to blow heated air into an air flow of the print substrate dryer that is leaving the printer after passing by a printed substrate.

15. The medium of claim 14, having further instructions thereon that when executed cause a printer controller to estimate an amount of ink to be printed and to control the blow based on the estimate.

16. The medium of claim 15, wherein:

the instructions to estimate an amount of ink include instructions to estimate the amount of ink based on a plot preview; and the instructions to control the blow include instructions to perform one or more of: start the blow; stop the blow; adjust a temperature of the heated air; and adjust a flow of the blow.

17. A printer controller o execute the instructions on the processor readable medium of claim 14.

18. The medium of claim 14, having further instructions thereon that when executed cause the dryer to: blow heated air into a print zone in the printer; and blow heated air on to a print substrate downstream from the print zone to generate the air flow leaving the printer.

* * * * *